US006967294B1

(12) United States Patent
Hsu et al.

(10) Patent No.: US 6,967,294 B1
(45) Date of Patent: Nov. 22, 2005

(54) MICROSWITCH

(75) Inventors: Chia-Hsin Hsu, Hsin-Tien (TW); King-Long Lee, Hsin-Tien (TW)

(73) Assignee: Zippy Technology Corp., Hsin-Tien (TW)

( * ) Notice: Subject to any disclaimer, the term of this patent is extended or adjusted under 35 U.S.C. 154(b) by 0 days.

(21) Appl. No.: 10/994,251

(22) Filed: Nov. 23, 2004

(51) Int. Cl.[7] ..... H01H 15/00
(52) U.S. Cl. ..... 200/16 D; 200/339
(58) Field of Search ..... 200/6 BA, 6 B, 200/6 C, 6 BB, 335, 339, 535, 16 D, 313–315, 200/553–562

(56) References Cited

U.S. PATENT DOCUMENTS

| | | | | |
|---|---|---|---|---|
| 3,878,344 | A * | 4/1975 | Lockard | 200/6 B |
| 3,965,319 | A * | 6/1976 | Lockard | 200/310 |
| 6,242,706 | B1 * | 6/2001 | Miyata | 200/537 |
| 6,797,904 | B1 | 9/2004 | Ni et al. | |
| 2002/0148714 | A1 | 10/2002 | Minami | |

FOREIGN PATENT DOCUMENTS

| | | |
|---|---|---|
| TW | 477995 A | 3/2002 |
| TW | 492027 A | 6/2002 |
| TW | 517254 A | 1/2003 |
| TW | 562228 A | 11/2003 |

* cited by examiner

*Primary Examiner*—Elvin G. Enad
*Assistant Examiner*—Lisa Klaus
(74) *Attorney, Agent, or Firm*—Birch, Stewart, Kolasch & Birch, LLP

(57) ABSTRACT

A microswitch that is easy to assemble and manufacture. The microswitch of this invention constantly keeps the connecting section of a resilient component for opening/closing an electric switch in contact with the first conductive section of a first conductive terminal in the main body of the microswitch, and houses a plate-shaped second conductive section with a contact area inside the main body. The first and second conductive sections of the resilient component generate signals preset by the microswitch for an initial signal connection state to a final connection state by a displacement produced by pressing a press button on a contact area of the second conductive terminal in order to increase the distance required for controlling the signal connection and allow the resilient component to have an effective deformation and provide the best resilience of the press button.

8 Claims, 7 Drawing Sheets

MICROSWITCH

FIELD OF THE INVENTION

The present invention generally relates to microswitches, more particularly to a microswitch that provides several operating directions for opening/closing an electric switch.

BACKGROUND OF THE INVENTION

To improve the low precision for manufacturing and assembling the "small switches" as disclosed in the R.O.C. Patent Publication No. 517254 and the "lever switches" as disclosed in the U.S. Publication No. 2002/0148714, the inventor of this invention had filed a R.O.C. patent application entitled "Microswitch (II)". Such patent application granted and published with Publication No. 562228 discloses an easy-to-assemble and easy-to-manufacture microswitch without changing the dimensions of existing products or requiring a complicated manufacturing process or a strict precision control.

The easy-to-assemble and easy-to-manufacture microswitch comprises a connecting section disposed between a first and a second conductive sections of a resilient component, a fixing section coupled to the resilient component and disposed in an accommodating groove of a press button at the position corresponding to the connecting section, so that the first conductive section of the resilient component is kept constantly in contact with a first contact section of the first conductive terminal extended into a chamber, and the second conductive section is moved downward by a corresponding pressing section on the press button to be in contact with a second conductive terminal as to extend the second conductive terminal to the second contact section of the chamber, and thus defining an easy-to-assemble microswitch. Although the microswitch according to this patent has solved the precision problem, it still cannot meet the strict requirements of the microswitch such as the distance required for the signal connection and the quick restoration of the press button after being released mainly due to the parallel arrangement of the first and second conductive terminals disposed in the chamber of the main body. Therefore, the distance required for signal connections is limited by the provided space. In addition, the distance between the first and second conductive sections of the resilient component is short, as shown in the drawings of the patent specification. Thus, the compression produced by the press button is limited, and the press button cannot quickly resume its original position after being released.

In view of the foregoing shortcomings, the inventor of the present inventor also filed and was granted with a "Microswitch (III)" with U.S. Pat. No. 6,797,904. Such patent discloses an easy-to-assemble and easy-to-manufacture microswitch, which constantly keeps a first connecting section of a resilient component for opening/closing an electric switch in contact with the first conductive terminal in the main body of the microswitch, and houses a plate-shaped second conductive section with a contact area inside the main body. The second conductive sections of the resilient component generate signals preset by the microswitch for an initial signal connection state to a final connection state by a displacement produced by pressing a press button on a contact area of the second conductive terminal in order to increase the distance required for controlling the signal connection and allow the resilient component to have an effective deformation and provide the best resilience of the press button.

However, the foregoing prior arts only can produce signal connections by applying a force from a vertical direction or only one side of a transversal direction. If a user chooses to apply a force from the other side of the transversal direction, the foregoing prior arts may reverse the installing direction, but if the existing electronic devices are necessary to produce signal connections by applying a force from a vertical direction or both sides of a transversal direction, the foregoing prior arts cannot meet such requirements.

The R.O.C. Pat. Nos. 492027 and 477995 disclosed a switch device that can produce signal connections by a force exerted from a vertical direction and both sides of a transversal direction. Since this type of switch is still designed by constantly keeping a conductive section at one end of the resilient component in contact with a conductive terminal and using a conductive section at the other end as a movable contact point and connecting an operating rod in the switch body to another conductive terminal, the design of this type of switch not only requires complicated components and laborious assembly, but also involves difficult controls on pressing and resuming process.

SUMMARY OF THE INVENTION

The primary objective of the present invention is to overcome and avoid the foregoing shortcomings. This invention adopts the design concept of the "Microswitch (III)" and makes further improvements to provide a microswitch that is easy to assemble and manufacture, and can produce a signal connection by applying a force from a vertical direction of both sides of a transversal direction. The microswitch of the invention constantly keeps the connecting section of a resilient component for opening/closing an electric switch in contact with the first conductive section of a first conductive terminal in the main body of the microswitch, and houses a plate-shaped second conductive section with a contact area inside the main body. The first and second conductive sections of the resilient component generate signals preset by the microswitch for an initial signal connection state to a final connection state by a displacement produced by pressing a press button on a contact area of the second conductive terminal in order to increase the distance required for controlling the signal connection and allow the resilient component to have an effective deformation and provide the best resilience of the press button.

DETAILED DESCRIPTION OF THE PREFERRED EMBODIMENTS

To make it easier for our examiner to understand the objective of the present invention, its structure, innovative features, and performance, we use a preferred embodiment together with the attached drawings for a detailed description of the invention.

Figure 1:
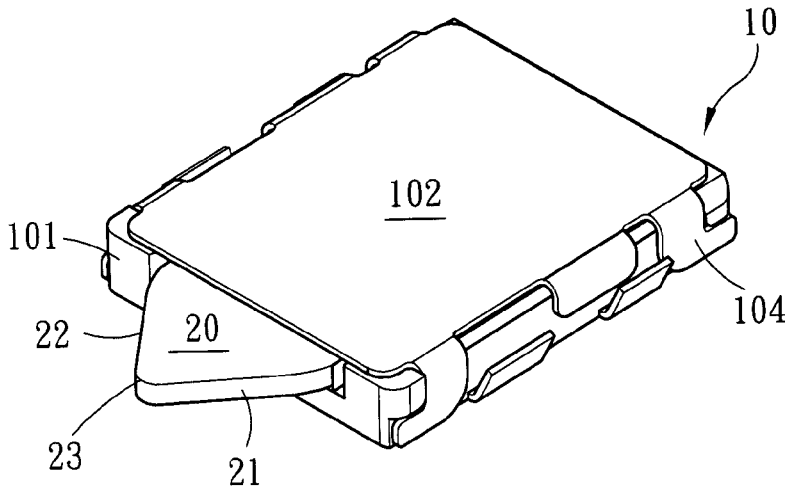
FIG. 1 is a perspective diagram of the present invention.
Figure 2:
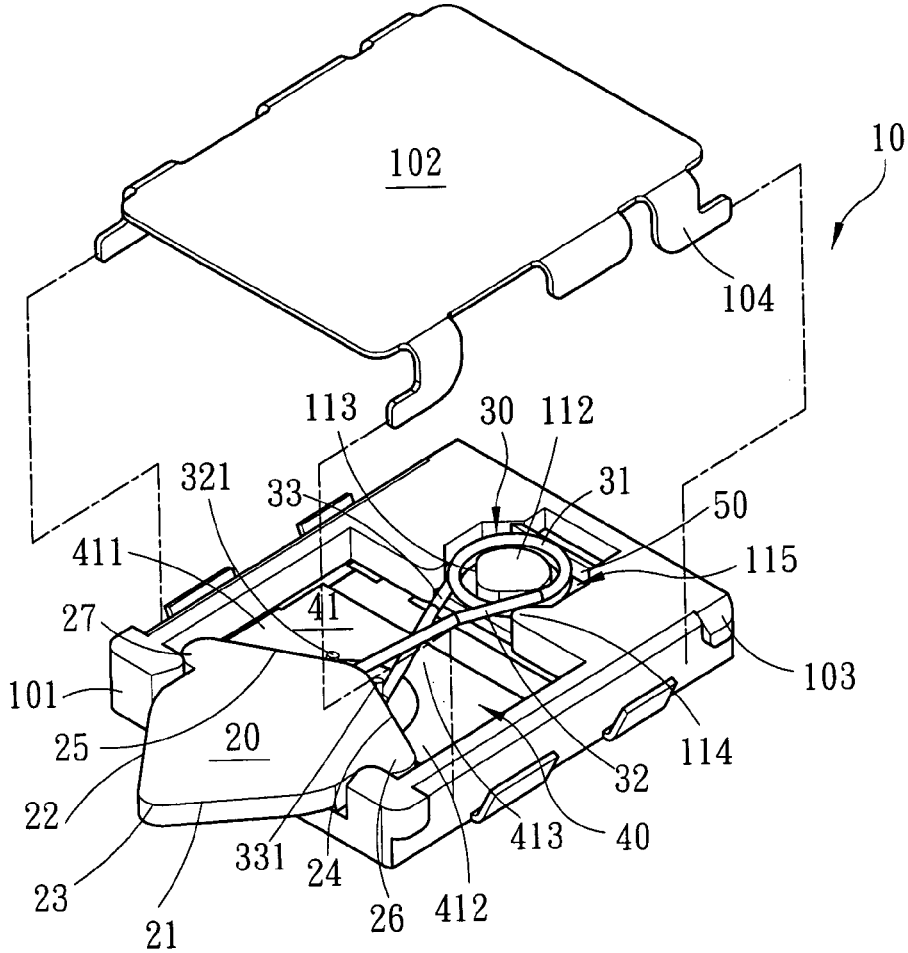
FIG. 2 is a view of the structure of the present invention when its cover is opened.
Figure 3:
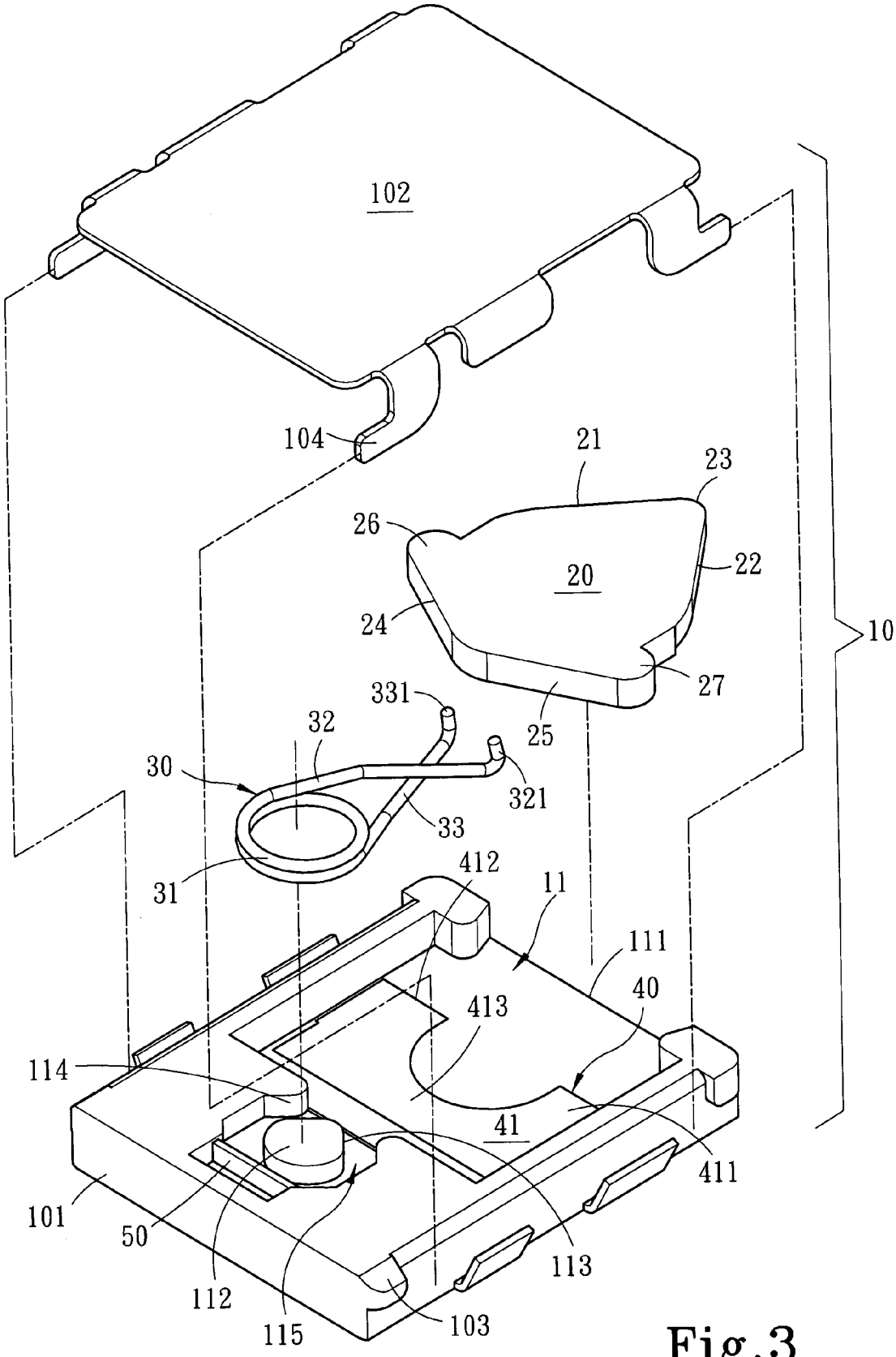
FIG. 3 is an exploded view of the present invention.

Please refer to FIGS. 1 to 3 for the present invention. The microswitch of the invention comprises: a main body 10 having a chamber 11 therein; a first conductive terminal 50 and a second conductive terminal 40 disposed on the chamber 11; a press button 20 disposed in the chamber 11 and rotably coupled to a main body 10 for supporting the main body 10; two force acting surfaces 21, 22 disposed at the bottom of the press button 20 for providing an elastic force to push the press button 20 up and protruded from the main body 10; a force acting end 23 disposed between the two force acting surfaces 21, 22 and having a first conductive section 32 and a second conductive section 33, and an assembling section 31 disposed between the first and second conductive sections 32, 33 to contact with a resilient component 30 of the first and second conductive terminals 50, 40 respectively; wherein the first and second conductive sections 32, 33 of the resilient component 30 are bent to define a first electric connection end 321 and a second electric connection end 331. The main body 10 of the invention comprises a base 101, a cover 102 corresponding to the fixing section 103 and positioning ear 104 to define a chamber 11, an open end 111 disposed on the base 101 for exposing the press button 20 and connecting the chamber 11, and a fixing section 112 of an assembling resilient component 30 disposed in the chamber 11 of the main body 10 and corresponsive to the assembling section 31. The design of the foregoing press button 20 comprises two force acting surfaces 21, 22 disposed on the main body 10 at the section where the press button 20 is exposed; two pressing surfaces 24, 25 of the first and second conductive sections 32, 33 of the pressing resilient component 30 being disposed in the chamber 11 at the section where the press button 20 is disposed; and a limit end 26, 27 formed at the end of two pressing surfaces 24, 25 respectively; characterized in that the assembling section 31 of the resilient component 30 is constantly kept in contact with the first conductive terminal 50, and the first and second conductive sections 32, 33 are pressed down by the press button 20 to touch the second conductive terminal 40, and the contact area of the first and second conductive terminals 32, 33 and the second conductive terminal 40 should satisfy the initial signal connection state to the final signal connection state preset by the microswitch, and the contact area 41 of the second conductive terminal 40 comprises a first and a second contact sections 411, 412 being perpendicular to the first conductive terminal 50 and disposed in the chamber 11 for being contacted by the first and second conductive sections 32, 33 of the resilient component 30; and a connecting section 413 disposed between the first and second contact sections 411, 412.

Figure 4B:
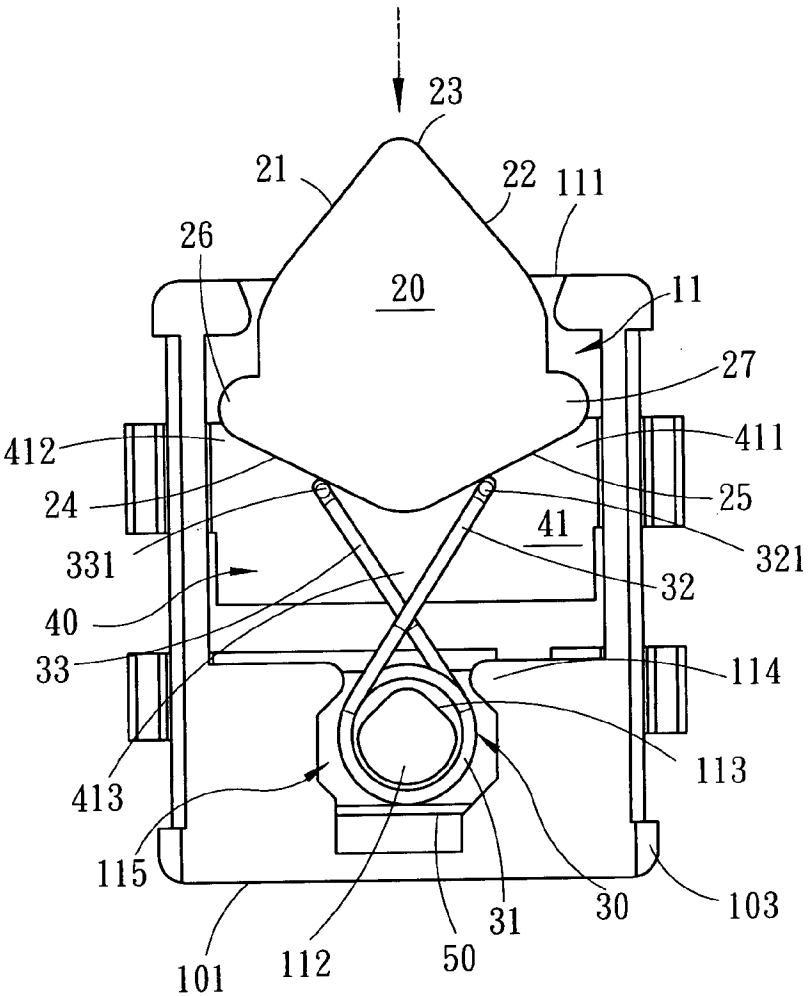
FIGS. 4A to 4C are views of applying a vertical force to the present invention.
Figure 4A:
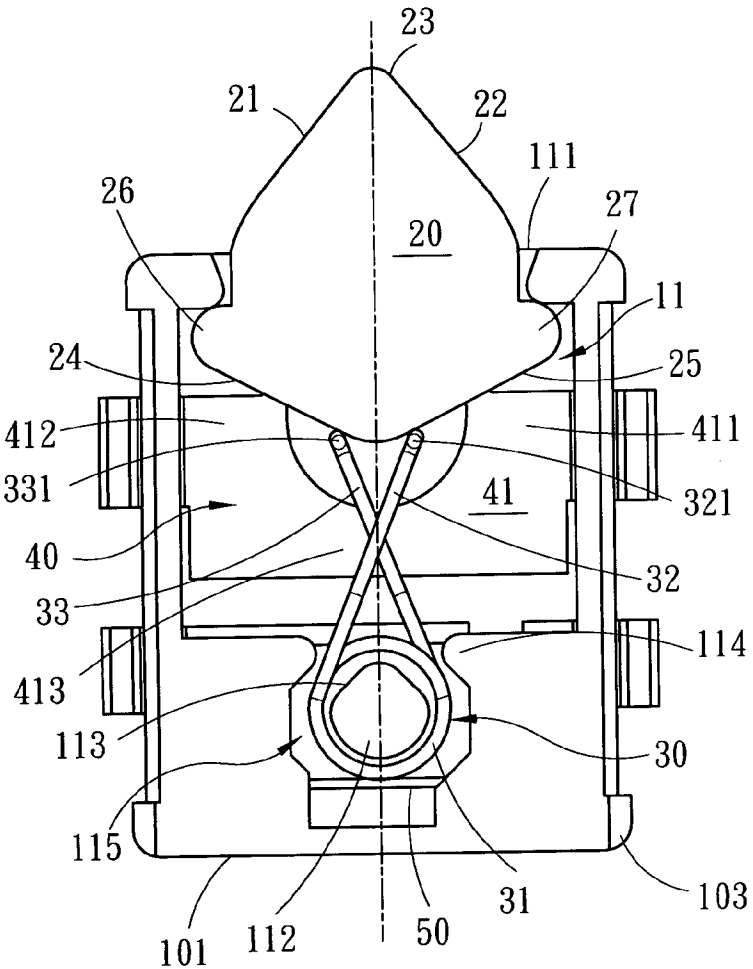
Figure 4C:
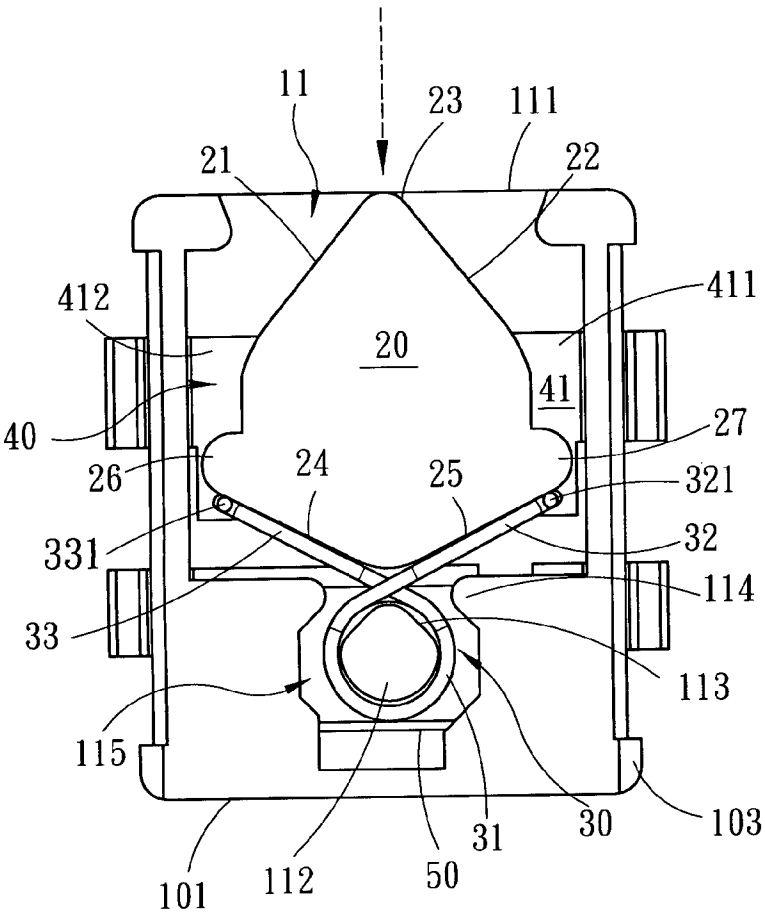

Please refer to FIGS. 4A to 4C for the views of applying a vertical force to the present invention. Since the plate-shaped second conductive terminal 40 installed in the chamber 11 has a contact area 41 and the first and second conductive sections 32, 33 of the resilient component 30 are bent into a first and a second electric connecting ends 321, 331 and disposed between a first and second contact section 411, 412 of the contact area 41 respectively. Such position is defined as a signal disconnection state. If a vertical force is applied onto the press button 20, the force acting end 23 at the top of the press button 20 moves vertically down by the force. Since the assembling section 31 of the resilient component 30 is restricted by the fixing section 112 of the chamber 11, so that the two pressing surfaces 24, 25 at the bottom of the press button 20 simultaneously press both sides of the first and second conductive sections 32, 33 of the pressing resilient component 30 for the displacement. Since the assembling section 31 of the resilient component 30 is constantly kept in contact with the first conductive terminal 50, therefore when the press button moves to its highest point, the first and second electric connecting ends 321, 331 of the first and second conductive sections 32, 33 are connected to the first and second contact sections 411, 412 of the contact area 41 of the second conductive terminal 40 as shown in FIG. 4B to define an initial signal connection state. When the press button 20 moves to its lowest point as shown in FIG. 4C, the contact area 41 of the second conductive terminal 40 satisfies the required movement of the press button. The first and second electric connecting ends 321, 331 of the first and second conductive sections 32, 33 are kept in contact with the contact area 41 for the connection when the press button is pressed down. Therefore, the press button 20 defines a final signal connection state is at its lower point when it is moved to its lowest point. The traveling distance of the signal from the initial signal connection state to the final signal connection state will comply with the actual traveling distance of the press button 20, and thus the microswitch of the present invention can provide the best signal traveling distance design. Further, the electric current of the microswitch is very small, and thus when the first and second electric connecting end 321, 331 moves on the contact area 41, it will not produce sparks or cause accidents.

Further, since the distance between the first conductive section 32 and the second conductive section 33 of the resilient component 30 is larger than that of the traditional microswitch, therefore when the press button 20 moves to its lowest point, the resilience stored in the resilient component 30 is increased and fully satisfy the maximum stored resilience of the assembling section 31, but it will not affect the constant contact between the assembling section 31 of the resilient component 30 and the first conductive terminal 50. The fixing section 112 of the chamber 11 comprises a limit section 114 disposed at the outside of the fixing section 112 to enclose an installation space 115 for installing the resilient component 30; and also a compressed surface 113 formed at the external periphery of the fixing section 112 of the chamber 11 for providing a more elastic space for the assembling section 31 of the resilient component 30 to store the best resilience. If the press button 20 is released, the press button 20 will resume its original position immediately and quickly and effectively release the signal connection state.

Figure 5A:
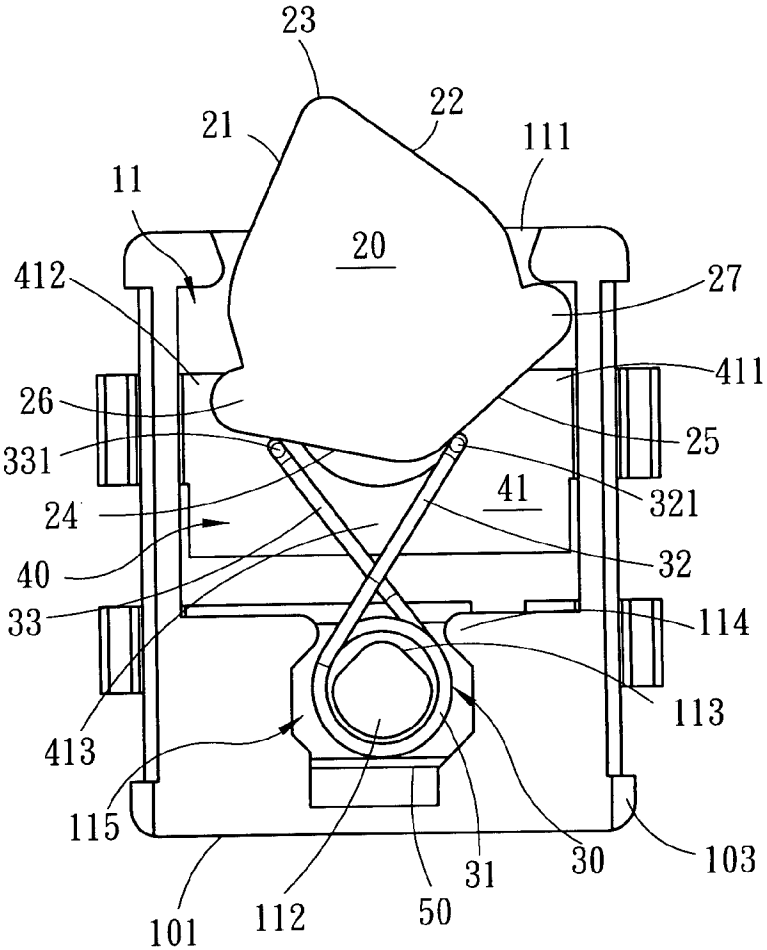
FIGS. 5A to 5C are views of applying a transversal force from the right side of the present invention.
Figure 5C:
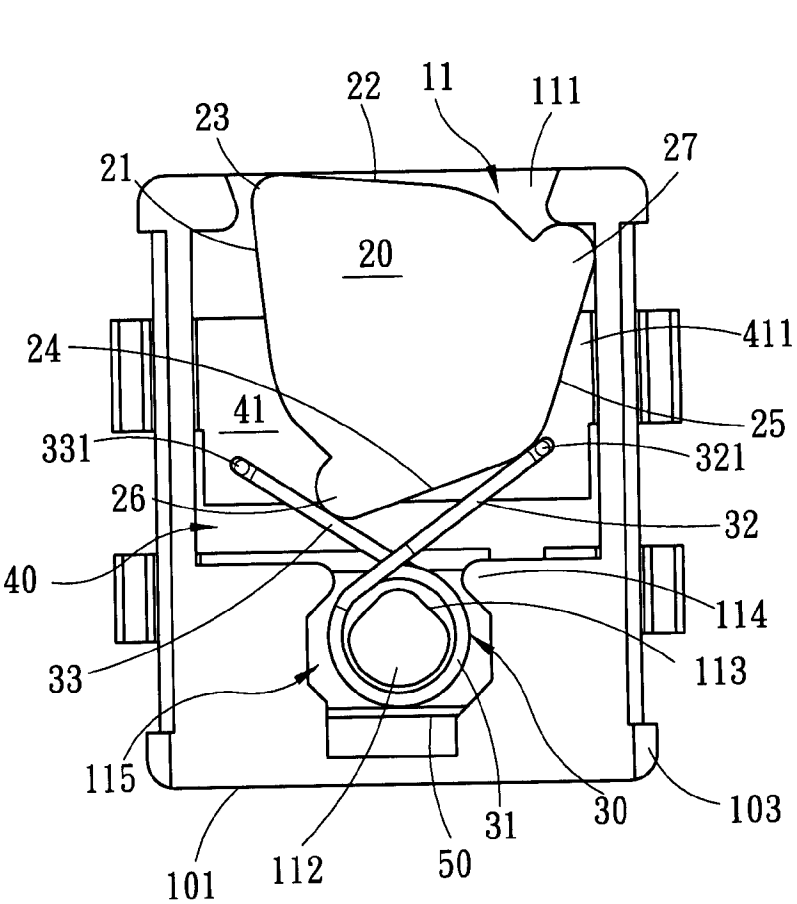
Figure 5B:
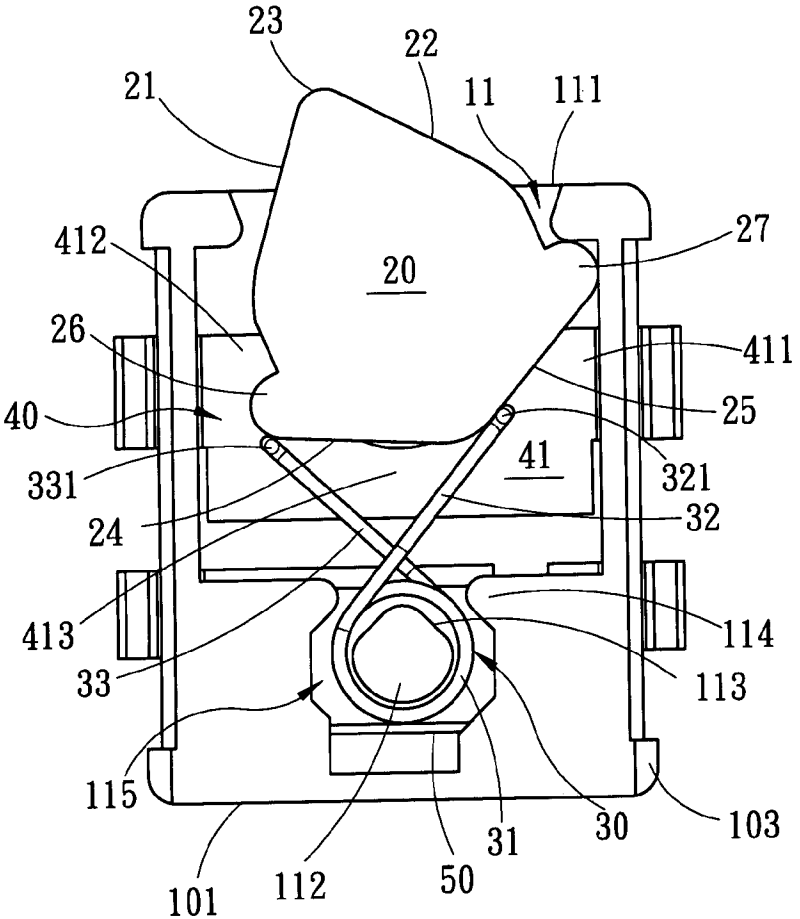
Figure 6B:
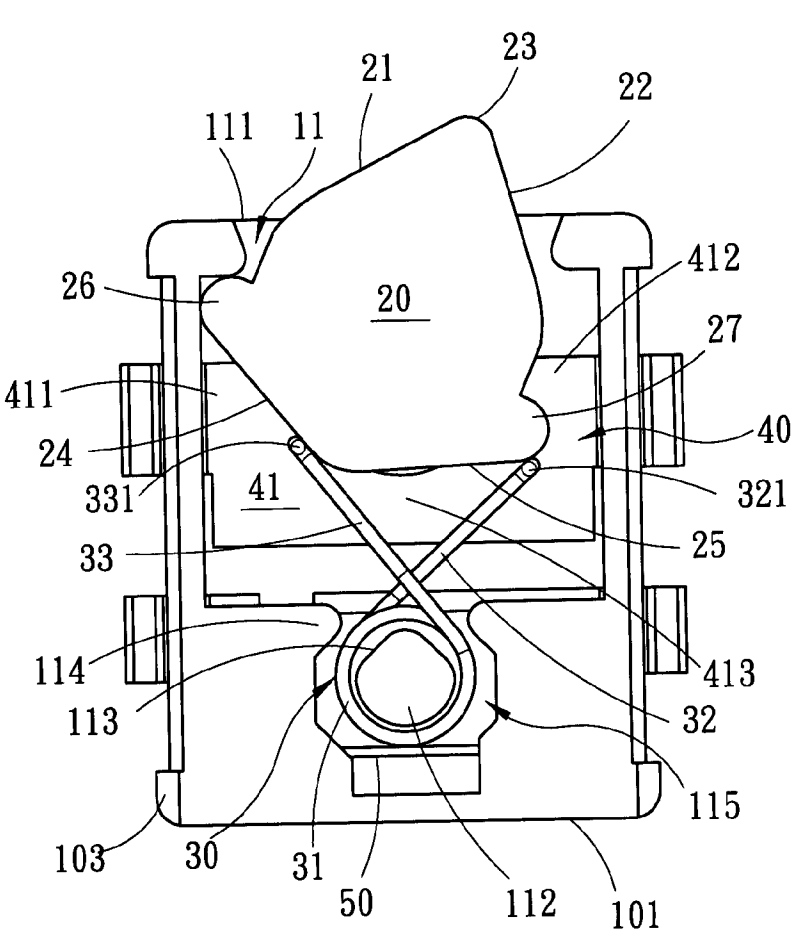
FIGS. 6A to 6C are views of applying a transversal force from the left side of the present invention.
Figure 6A:
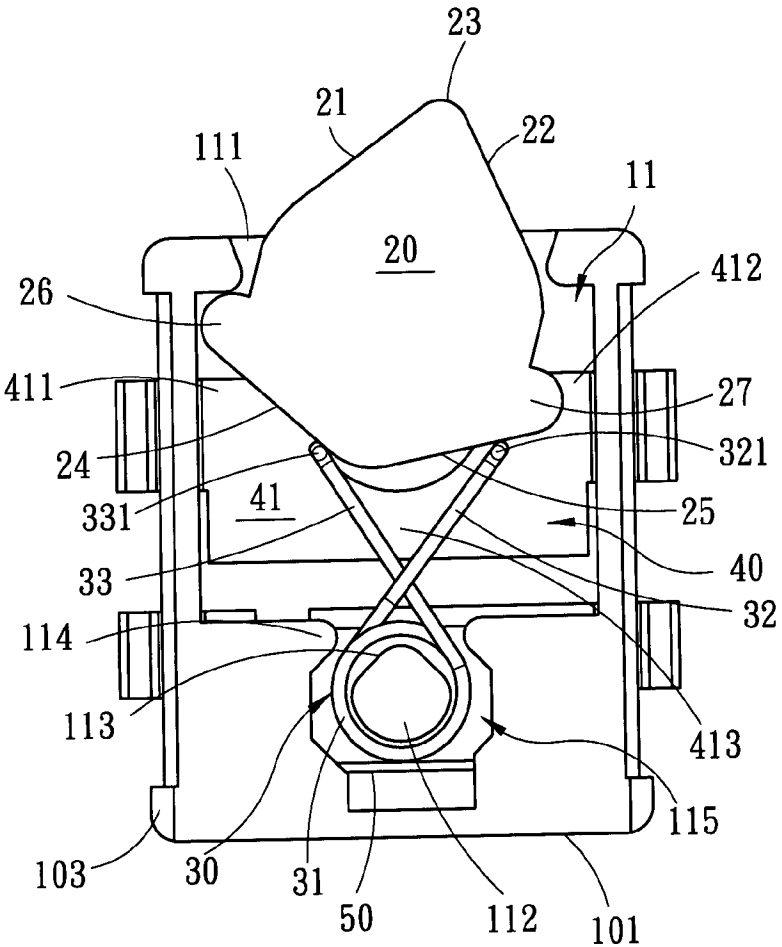
Figure 6C:
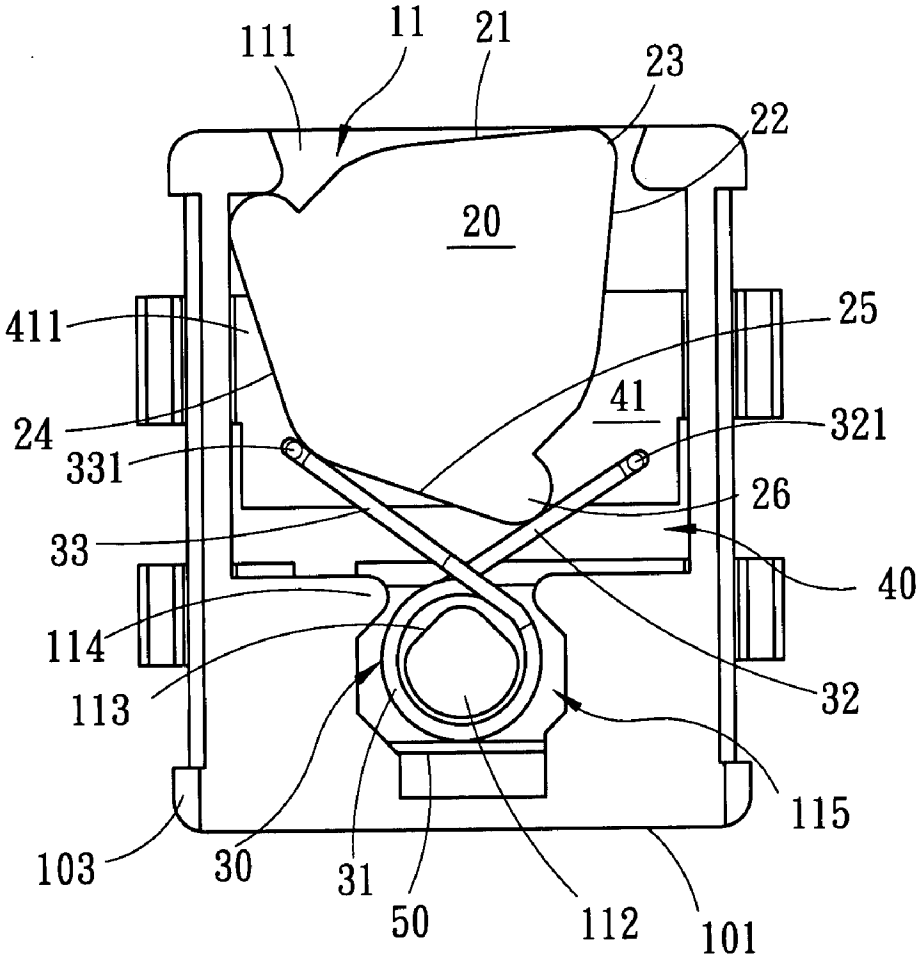

Please refer to FIGS. 5A to 5C for the views of applying a transversal force from the right side of the present invention and FIGS. 6A to 6C for the views of applying a transversal force from the left side of the present invention. If a transversal force is applied to a press button 20 from the right side or the left side, the press button 20 will move downward towards the side opposite to the applying force. By that time, at least one force acting surface of the press button 20 contacts the first and second conductive sections 32, 33 of the pressing resilient component 30 with the contact area 41 of the second conductive terminal 40 to define an initial signal connection state. When the press button 20 moves to its lowest point to define a final signal connection state, the limit ends 26, 27 at the end sections of the two pressing surfaces 24, 25 to press against both sides of the open end 111 of the main body to prevent the press button 20 from falling into the chamber 11 of the main body due to an excessive deviation. The resilient component 30 can resume its original state when the first and second conductive sections 32, 33 of the resilient component 30 are released by the resilience.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A microswitch comprising a main body having a chamber therein, and said main body having first and second conductive terminals disposed on said chamber, a press button disposed on said chamber so as to be supported on said main body by a free rotation, and a resilient component disposed under said press button for providing an elastic force to push said press button up to form a protruded section from said main body; and the resilient component having first and second conductive sections and a connecting section disposed between said first and second conductive sections for contacting said first and second conductive terminals, characterized in that:

an assembling section, defined between said first and second conductive sections of said resilient component;

a fixing section, coupled to said resilient component and disposed in a chamber of said main body such that said first conductive terminal of said connecting section of said resilient component being constantly kept in contact with said first and second conductive sections, and said first and second conductive sections being pressed down by a force provided by said press button to contact with said second conductive terminal, and said first and second conductive sections and a contact area of said second conductive terminal capable of meeting requirements for an initial signal connection state to a final signal connection state preset by said microswitch.

2. The microswitch of claim 1, wherein said main body comprises a base and a cover, and the chamber is defined by a fixing section and a positioning ear corresponding to said base and cover respectively, and an open end is disposed on said base for exposing said press button and interconnecting said chamber.

3. The microswitch of claim 1, wherein said first and second contact sections of said first and second conductive sections of said resilient component and being perpendicularly disposed in said chamber.

4. The microswitch of claim 1, wherein first and second conductive sections of said resilient component are bent to define first and second electric connecting ends respectively.

5. The microswitch of claim 1, wherein said press button at the position where said press button is protruded from said main body comprises two force acting surfaces and a force acting end disposed between said two force acting surfaces, and said press button at the position where said press button is disposed in said chamber comprises two pressing surfaces of said first and second conductive sections of said pressing resilient component to define a limit end.

6. The microswitch of claim 1, wherein a positioning section of said chamber forms a compressing surface at an external periphery of said positioning section.

7. The microswitch of claim 1, wherein said positioning section of said chamber comprises a limiting section at an exterior of said positioning section to enclose an installation space for installing said resilient component.

8. A microswitch, comprising a main body having a chamber therein, and said main body having first and second conductive terminals disposed in said chamber, a press button disposed on said chamber so as to be supported and allowed free rotation on the main body, and a resilient component having first and second conductive sections, and an assembling section disposed between said first and second conductive sections for contacting said first and second conductive terminals of said resilient component respectively, characterized in that:

said assembling section is constantly kept in contact with said first conductive terminal;

said second conductive terminal is plate-shaped and disposed in said chamber and having a contact area; and said first and second conductive sections of said resilient component are driven by said press button to move on said contact area of said second conductive terminal to define an initial signal connection state to a final signal connection state preset by said microswitch.

* * * * *